United States Patent [19]

Shono et al.

[11] Patent Number: 4,487,524

[45] Date of Patent: Dec. 11, 1984

[54] METHOD AND APPARATUS OF FORMING SAND PILES FOR IMPROVING A SOFT GROUND

[75] Inventors: Masaru Shono, Toyonaka; Takahiro Kawakami, Takatsuki; Toshiyuki Matsumoto, Fujisawa; Thoru Tamura, Abiko; Hideki Matsumoto, Matsubara, all of Japan

[73] Assignee: Fudo Construction Co., Ltd., Osaka, Japan

[21] Appl. No.: 419,313

[22] Filed: Sep. 17, 1982

[30] Foreign Application Priority Data

Sep. 22, 1981 [JP] Japan ..... 56-149708
Mar. 25, 1982 [JP] Japan ..... 57-47630

[51] Int. Cl.[3] ..... E02B 11/00

[52] U.S. Cl. ..... 405/50; 405/36; 405/240; 405/232

[58] Field of Search ..... 405/50, 240, 36, 37, 405/43, 45, 258, 231, 232

[56] References Cited

U.S. PATENT DOCUMENTS

| | | | |
|---|---|---|---|
| 3,303,656 | 2/1967 | Landau | 405/50 |
| 3,420,063 | 1/1969 | Bodine | 405/50 |
| 3,648,467 | 3/1972 | Ogawa | 405/50 |
| 3,707,847 | 1/1973 | Godley et al. | 405/50 |
| 3,772,892 | 11/1973 | Ogawa | 405/50 X |
| 4,126,007 | 11/1978 | Mars | 405/240 X |

*Primary Examiner*—Dennis L. Taylor
*Attorney, Agent, or Firm*—Armstrong, Nikaido, Marmelstein & Kubovcik

[57] ABSTRACT

A method for uniformly improving a soft ground is proposed. It includes the steps of driving a pipe into the ground, putting sand thereinto and pulling up the pipe gradually while discharging and compacting the sand. In forming the sand piles, the diameter and/or strength of the sand piles are changed according to the soil nature of the ground to be improved to improve the ground uniformly.

6 Claims, 5 Drawing Figures

METHOD AND APPARATUS OF FORMING SAND PILES FOR IMPROVING A SOFT GROUND

The present invention relates to a method and apparatus for improving a soft ground of a varying soil nature or texture to a ground of a uniform strength by installing sand piles in the ground.

In designing the improvement of a soft ground by driving sand piles, the strength of the ground is usually estimated from the results of soil explorations made at a plurality of points in the area to be improved, and the target strength of ground, and the required diameter, pitch and other parameters of the sand piles are determined from the estimated strength and the weight, shape, etc. of the structure which is to be built on the ground after improvement. Conventionally, improvement works are executed under the assumption that the target strength can be achieved by installing sand piles according to the predetermined parameters. However, if the strength of the ground to be improved varies, the strength of the improved ground, too, varies accordingly, because the estimated strength of ground used for designing the piles is an average value. Therefore, the improved ground necessarily has a varying strength. This is one problem to be solved in the conventional process.

A basic feature of the present invention is that in order to solve the problem, in forming sand piles in the ground, the diameter and/or strength of the sand piles are changed according to the nature or strength of the ground to be improved.

It is known to form a sand pile in the ground to be improved by means of a hollow pipe provided at its lower end with a sand discharging/compacting member adapted to be vertically driven under compulsion. The pushing force F applied by the discharging/compacting member is expressed by the equation;

$$F=K\cdot A\cdot B\cdot C$$

wherein K is a constant, A is the diameter of a sand pile, B is its strength, and C is the strength of the ground.

As a concrete feature of the present invention, the value F is used as an index for controlling the work of forming the sand piles, and, in the process of forming sand piles while operating the sand discharging/compacting member by means of a hydraulic cylinder, the diameter and/or strength of the sand pile is changed with the pushing force applied by the member kept equal to the present value.

The diameter of the sand pile may be changed by changing the speed at which the pipe is pulled up and/or the amount of water injected around the lower end of the pipe. The strength of the sand pile may be changed by changing the frequency and/or amplitude of the vibrations imparted to the sand discharging/compacting member.

It is desirable that the pushing force F of the sand discharging/compacting member just before the end of downward stroke of the piston in the hydraulic cylinder is detected and compared with the preset value (Fo) and the diameter and/or strength of the sand pile being formed are changed according to the result of the comparision. Therefore, in accordance with the present invention, a hydraulic cylinder is used to forcibly move the sand discharging/compacting member in a vertical direction, and there are provided means for detecting the working distance of the piston of the hydraulic cylinder by detecting the flow rate of fluid supplied to the hydraulic cylinder, means for sensing the pressure of the fluid when the downward stroke of the piston has reached to a predetermined value, means for comparing the pushing force of the sand discharging/compacting means computed from the fluid pressure with a predetermined value, and means for changing the diameter and/or strength of the sand piles according to the result of the comparison.

An object of the present invention is to provide a method of installing sand piles for the improvement of a soft ground by which it is improved to a ground having a uniform strength.

Another object is to provide a method and an apparatus for installing such sand piles for the improvement of a soft ground in an effective controlled manner.

Other objects and features of the present invention will become apparent from the following description taken with reference to the accompanying drawings, in which.

Figure 1A:
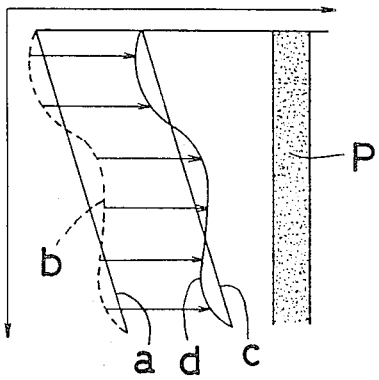
FIG. 1A is a graph of depth vs. strength of the ground for the conventional method.
Figure 1B:
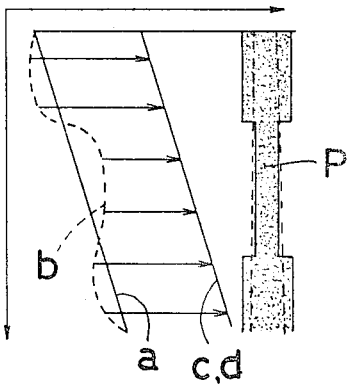
FIG. 1B is a similar graph for the process according to the present invention.

Referring to the drawings, FIGS. 1A and 1B are graphs showing the relationship between the depth and the strength of the ground, for the conventional method and the method according to the present invention, respectively. In these graphs, a shows the estimated strength of the ground to be improved, b the actual strength of the same, c the target strength of the improved ground, and d the actual strength of the same. The letter P denotes a sand pile formed in the ground. It will be seen from these graphs that in the conventional method in which the diameter of the sand pile formed is fixed, the strength of the improved ground varies widely as the actual strength of the ground to be improved, whereas in the method according to the present invention in which the diameter of the sand pile is changed according to the strength of the ground, the actual strength of the improved ground is substantially the same as its target strength. This means that in accordance with the present invention, the ground is improved to a uniform strength.

Figure 2:
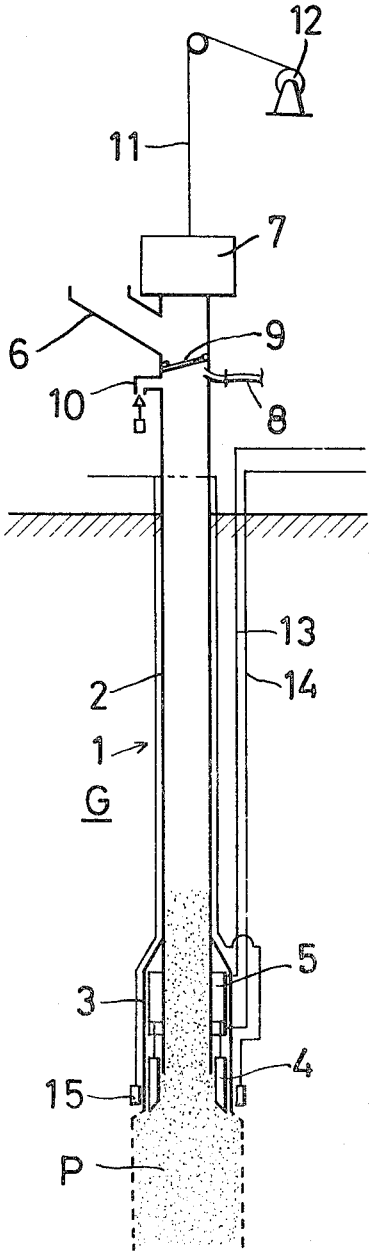
FIG. 2 is a schematic view showing the apparatus embodying the present invention.

Referring to FIG. 2, an apparatus 1 is used to install a compacted sand pile P. The apparatus 1 includes a hollow pipe 2, a short pipe 3, a member 4 for discharging and compacting the sand, a hydraulic cylinder 5 for moving the member 4 vertically, a hopper 6 through which the sand is dumped into the pipe 2, a driving unit 7 for driving the pipe 2 into ground, a compressed air supply pipe 8, a valve 9 for preventing escape of compressed air from the hopper, an exhaust valve 10, a wire 11 for suspending the pipe 2, a winch 12, hydraulic fluid lines 13 and 14, and water jet nozzles 15.

In order to install a sand pile in a soft ground G by use of the above-mentioned apparatus, the pipe 2 is firstly driven by means of the driving unit 7 to a predetermined depth with the wire 11 loosened. The driving of the pipe 2 into the ground is facilitated by jetting water into the ground G through the water nozzles 15 and/or operating the hydraulic cylinder 5 as well as the driving unit 7.

The pipe 2 is then pulled upwardly while discharging and compacting the sand by means of the sand discharging/compacting member 4. As the pipe 2 is pulled up, a sand pile P is formed gradually and upwardly. The pulling-up of the pipe is usually interrupted several times for sand replenishment. During the sand piling, compressed air is supplied into the pipe 2 from the air supply pipe 8 for easy discharge of sand.

As will be seen from FIG. 1B, in the present invention, if the diameter of the sand pipe is changed according to the change in nature or strength of the ground to be improved, at depths where the actual strength of the ground is greater than its estimated strength, the pile is given a smaller diameter than the design diameter, whereas at depths where it is less than the estimated strength, the pile is given a greater diameter than the design diameter.

The pile diameter can be changed either by changing the speed at which the pipe 2 is pulled up, or by jetting water from the water nozzles 15 around the lower end of the pipe 2 to soften the ground for a limited range.

In the present invention, if the strength of the sand pile is changed according to the change in the nature or strength of the ground to be improved, the sand pile is given a smaller strength (or density) than the design strength at depths where the actual strength of the ground is greater than the estimated strength, whereas it is given a greater strength than that at depths where the actual strength of the ground is less than the estimated strength.

The strength of the sand pile can be changed by changing the frequency and/or amplitude of the vibrations given to the sand discharging/compacting member 4.

The variation in the nature or strength of the ground to be improved can be detected in various ways, e.g. by means of a strain gauge or a load cell mounted on the pipe 2 at a suitable point.

Figure 3:
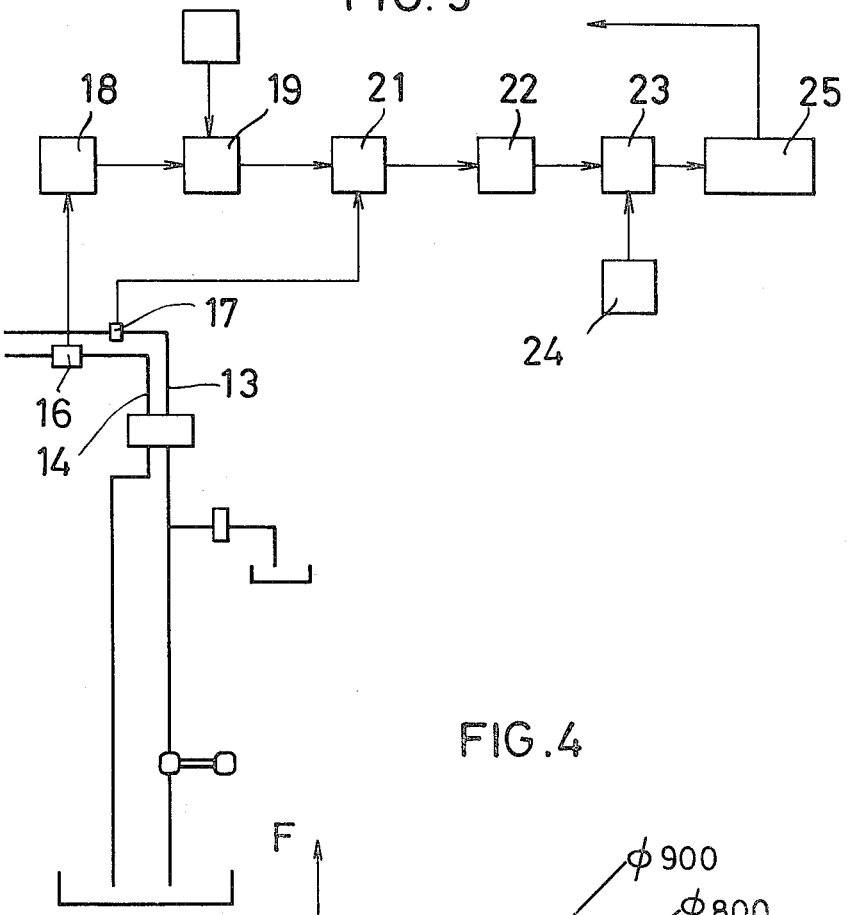
FIG. 3 is a block diagram of the control circuit used in the present invention.

The pushing force F applied by the sand discharging-/compacting member 4 can be detected e.g. in the manner described below, from the fluid pressure just before the end of the downward stroke of the piston in the hydraulic cylinder 5. In FIG. 3, a flowmeter 16 provided in a fluid line 14 for the hydraulic cylinder 5 generates pulses proportional to the flow rate per unit time. The pulses are integrated for time by an integrator 18 to determine the number of pulses proportional to the volume of fluid which passed through the flowmeter 16 during the period of time from the start to end of the downward stroke of the piston in the cylinder 5. The pulse signal is converted to a voltage, which is given to a comparator 19.

A voltage preset in a setter 20 is given to the comparator 19, said voltage being proportional to the volume of fluid required for the piston of the cylinder 5 to go down to just before the end of its downward stroke. The comparator 19 compares the voltage from the integrator 18 with the preset voltage and gives a signal to a memory circuit 21 when these two voltages become equal to each other.

The fluid pressure in the fluid line 13 is sensed every minute by a pressure sensor 17 and converted to a voltage, which is given to a memory circuit 21. The memory circuit registers the voltage from the sensor 17 in response to the signal from the comparator 19 and sends the registered voltage to a computing circuit 22.

The computing circuit determines the pushing force F on the basis of the voltage from the memory circuit 21 (proportional to the fluid pressure just before the end of downward stroke of the piston) and the effective sectional area of the cylinder 5 registered beforehand. The value F thus obtained is compared at a comparator 23 with a value Fo preset in a setter 24.

Figure 4:
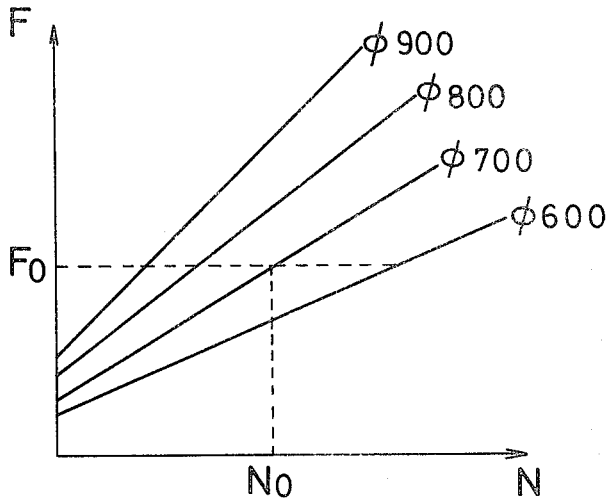
FIG. 4 is a graph showing how a standard F value is determined.

The preset value F is determined as follows: Since the same density or strength of the sand pile can be obtained if the material used (usually sand) and the parameters in the sand piling are the same, a graph such as in FIG. 4 showing correlation among the value F, the sand pile diameter and the strength N of the ground to be improved can be prepared from the results of the test sand pilings performed for this purpose. By use of this graph, is determined a value Fo corresponding to the estimated strength No of the ground and the design diameter of the sand pile (700 mm in FIG. 4) required. The preset value F may be changed with the depth.

In the measurements during the test piling, the value F may be measured in the above-mentioned manner; the diameter of the sand pile is measured in the conventional manner by means of a depth meter and a sand volume meter (not shown) mounted on the pipe 2; and the strength of the ground is measured by use of an ordinary tester. The latter can also be measured by utilizing the apparatus 1, though not described here in detail.

The comparator 23 compares the detected F value with the preset F value (Fo), and, if there is any difference, sends a signal to a control unit 25, which gives a control signal to adjust some parameter governing the pile diameter, e.g. the speed at which the pipe 2 is pulled up by the winch 12.

At depths where the actual strength of the ground is greater than No, the detected F value will exceed the preset value Fo so that the speed at which the pile is pulled up by the winch is increased. As a result, the diameter of the sand pile will be less than the standard value (e.g. 700 mm). At depths where the actual strength of the ground is less than No, the speed is decreased to increase the diameter.

The diameter may be regulated by controlling the opening of the valve by use of the signal from the control unit 25 to adjust the volume of water jetted from the water nozzles 15.

In actual sand pilings in which the value F is controlled so as to be constant, some allowance is made above and below the preset value Fo. Control is usually carried out so that the detected F value (pushing force) will be between the upper and lower limits.

Although in the above-described embodiment the diameter of the sand pile is adjusted so that its strength remains constant, the strength of the sand pile may be changed with its diameter kept fixed. Also, both the diameter and strength of the sand pile may be changed so long as the F value is fixed.

If the strength of the sand piles is changed with their diameter fixed, it should preferably be done by changing the frequency and/or amplitude of the vibrations given to the sand discharging/compacting member 5, though it may be changed by imparting fine vibrations intermittently to the member 5 during its downward movement. Vibrations can be easily imparted to the member 5 by pulsating the fluid supplied to the hydraulic cylinder 5.

If both the diameter and strength of the sand piles are changed, this may be done by changing the speed of vertical movement or the stroke length of the sand discharging/compacting member 5 as well as in the above-mentioned manner.

Although in the preferred embodiment sand has been used to form a pile, the present invention may also be applied in cases where any similar material such as gravel, rubble and slag is used.

What is claimed is:

1. An apparatus of forming sand piles for improving a soft ground in a controlled manner, comprising:

a pipe driven into the ground and through which sand is supplied into the ground, sand discharging/compacting means disposed at the lower end of said pipe for discharging the sand out of said pipe and compacting it, a hydraulic cylinder having a piston for moving said sand discharging/compacting means vertically, detecting means for detecting the working distance of said piston by detecting the flow rate of fluid supplied to said hydraulic cylinder, sensor means for sensing the pressure of said fluid when the downward stroke of said piston has reached to a predetermined value, comparing means for comparing the pushing force applied by said sand discharging/compacting means, computed based on said fluid pressure with a predetermined value, and means for changing the diameter and/or strength of the sand piles according to the result of the comparison.

2. A method of forming sand piles for improving soft ground, comprising the steps of:

driving a pipe into the ground;

putting sand into said pipe; and pulling up said pipe gradually while discharging and compacting the sand with a piston disposed within a hydraulic cylinder including, detecting the working distance of said piston by detecting the flow rate of fluid supplied to said hydraulic cylinder, sensing the pressure of said fluid when the downward stroke of said piston has reached a predetermined value, comparing the pushing force, applied during the discharging and compacting step, which is based on said fluid pressure, with a predetermined value, and changing the diameter and/or strength of the said piles during the formation thereof according to the result of the comparison, thereby creating sand piles resulting in uniformly improved ground.

3. The method of claim 2, wherein said discharging and compacting is performed by a discharging/compacting member located near the lower end of said pipe which includes said piston and hydraulic cylinder.

4. The method of claim 3, wherein during the changing of the diameter and/or strength of the sand piles, the pushing force applied by said sand discharging/compacting member is kept equal to a predetermined value.

5. The method of claim 2 or 3, wherein the diameter of the sand piles is changed by adjusting the speed at which said pipe is pulled up and/or the amount of water jetted around the lower end of said pipe.

6. The method of claim 4, wherein the strength of the sand piles is changed by adjusting the frequency and/or the amplitude of vibrations imparted to said sand discharging/compacting member.

* * * * *